US009813826B2

(12) United States Patent
Hviid et al.

(10) Patent No.: US 9,813,826 B2
(45) **Date of Patent: *Nov. 7, 2017**

(54) EARPIECE WITH ELECTRONIC ENVIRONMENTAL SOUND PASS-THROUGH SYSTEM

(71) Applicant: Bragi GmbH, München (DE)

(72) Inventors: Nikolaj Hviid, München (DE); Friedrich Christian Föerstner, München (DE)

(73) Assignee: BRAGI GmbH, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/839,955

(22) Filed: Aug. 29, 2015

(65) Prior Publication Data

US 2017/0064460 A1 Mar. 2, 2017

(51) Int. Cl.
*H04R 25/00* (2006.01)
*H04R 1/10* (2006.01)

(52) U.S. Cl.
CPC ..... *H04R 25/43* (2013.01); *H04R 1/1016* (2013.01); *H04R 25/554* (2013.01); (Continued)

(58) Field of Classification Search
CPC ..... H04R 25/02; H04R 25/554; H04R 1/028; H04R 2225/025; H04R 2225/55; H04R 2460/11
See application file for complete search history.

(56) References Cited

U.S. PATENT DOCUMENTS 3,934,100 A 1/1976 Harada
4,150,262 A 4/1979 Ono
(Continued)

FOREIGN PATENT DOCUMENTS

| | | | |
|---|---|---|---|
| EP | 1017252 | A2 | 7/2000 |
| GB | 2074817 | | 4/1981 |
| JP | 06292195 | | 10/1998 |
| WO | 2014043179 | A2 | 3/2014 |
| WO | 2015110577 | A1 | 7/2015 |
| WO | 2015110587 | A1 | 7/2015 |

OTHER PUBLICATIONS

Announcing the $3,333,333 Stretch Goal (Feb. 24, 2014).
(Continued)

*Primary Examiner* — Brian Ensey
(74) *Attorney, Agent, or Firm* — Goodhue, Coleman & Owens, P.C.

(57) ABSTRACT

An ear piece for use by an individual having an external auditory canal includes an earpiece housing configured for placement at, on or within the external auditory canal of the individual, a processor disposed within the ear piece housing, at least one microphone disposed at the earpiece housing wherein the at least one earpiece is positioned to detect ambient environmental sound, and at least one speaker disposed within the earpiece housing at a position to direct sound towards a tympanic membrane of the individual. The ear piece is configured to detect ambient environmental sound proximate the external auditory canal of the individual using the at least one microphone and reproduce the ambient environmental sound at the at least one speaker within the earpiece housing. The ear piece may include a spectrometer for detecting ambient environmental lighting. The earpiece may include a number of biological sensors. The ear piece may include a magnetic induction electrical conduction electromagnetic field transceiver for linking the device to personal area networks or other devices.

83 Claims, 4 Drawing Sheets

(52) U.S. Cl.
CPC .... *H04R 2225/025* (2013.01); *H04R 2225/61* (2013.01); *H04R 2460/05* (2013.01)

(56) References Cited

U.S. PATENT DOCUMENTS

| | | | | |
|---|---|---|---|---|
| 4,334,315 | A | 6/1982 | Ono et al. | |
| 4,375,016 | A | 2/1983 | Harada | |
| 4,588,867 | A | 5/1986 | Konomi | |
| 4,654,883 | A | 3/1987 | Iwata | |
| 4,682,180 | A | 7/1987 | Gans | |
| 4,791,673 | A | 12/1988 | Schreiber | |
| 4,865,044 | A | 9/1989 | Wallace et al. | |
| 5,191,602 | A | 3/1993 | Regen et al. | |
| 5,201,007 | A | 4/1993 | Ward et al. | |
| 5,280,524 | A | 1/1994 | Norris | |
| 5,295,193 | A | 3/1994 | Ono | |
| 5,298,692 | A | 3/1994 | Ikeda et al. | |
| 5,343,532 | A | 8/1994 | Shugart | |
| 5,363,444 | A | 11/1994 | Norris | |
| 5,497,339 | A | 3/1996 | Bernard | |
| 5,606,621 | A | 2/1997 | Reiter et al. | |
| 5,613,222 | A | 3/1997 | Guenther | |
| 5,692,059 | A | 11/1997 | Kruger | |
| 5,721,783 | A | 2/1998 | Anderson | |
| 5,749,072 | A | 5/1998 | Mazurkiewicz et al. | |
| 5,771,438 | A * | 6/1998 | Palermo | H02J 7/025 455/101 |
| 5,802,167 | A | 9/1998 | Hong | |
| 5,929,774 | A | 7/1999 | Charlton | |
| 5,933,506 | A | 8/1999 | Aoki et al. | |
| 5,949,896 | A | 9/1999 | Nageno et al. | |
| 5,987,146 | A | 11/1999 | Pluvinage et al. | |
| 6,021,207 | A | 2/2000 | Puthuff et al. | |
| 6,054,989 | A | 4/2000 | Robertson et al. | |
| 6,081,724 | A | 6/2000 | Wilson | |
| 6,094,492 | A | 7/2000 | Boesen | |
| 6,111,569 | A | 8/2000 | Brusky et al. | |
| 6,112,103 | A | 8/2000 | Puthuff | |
| 6,157,727 | A | 12/2000 | Rueda | |
| 6,167,039 | A | 12/2000 | Karlsson et al. | |
| 6,181,801 | B1 | 1/2001 | Puthuff et al. | |
| 6,208,372 | B1 | 3/2001 | Barraclough | |
| 6,275,789 | B1 | 8/2001 | Moser et al. | |
| 6,339,754 | B1 | 1/2002 | Flanagan et al. | |
| 6,408,081 | B1 | 6/2002 | Boesen | |
| D464,039 | S | 10/2002 | Boesen | |
| 6,470,893 | B1 | 10/2002 | Boesen | |
| D468,299 | S | 1/2003 | Boesen | |
| D468,300 | S | 1/2003 | Boesen | |
| 6,542,721 | B2 | 4/2003 | Boesen | |
| 6,560,468 | B1 | 5/2003 | Boesen | |
| 6,654,721 | B2 | 11/2003 | Handelman | |
| 6,664,713 | B2 | 12/2003 | Boesen | |
| 6,694,180 | B1 | 2/2004 | Boesen | |
| 6,718,043 | B1 | 4/2004 | Boesen | |
| 6,738,485 | B1 | 5/2004 | Boesen | |
| 6,748,095 | B1 | 6/2004 | Goss | |
| 6,754,358 | B1 | 6/2004 | Boesen et al. | |
| 6,784,873 | B1 | 8/2004 | Boesen et al. | |
| 6,823,195 | B1 | 11/2004 | Boesen | |
| 6,852,084 | B1 | 2/2005 | Boesen | |
| 6,879,698 | B2 | 4/2005 | Boesen | |
| 6,892,082 | B2 | 5/2005 | Boesen | |
| 6,920,229 | B2 | 7/2005 | Boesen | |
| 6,952,483 | B2 | 10/2005 | Boesen et al. | |
| 6,987,986 | B2 | 1/2006 | Boesen | |
| 7,136,282 | B1 | 11/2006 | Rebeske | |
| 7,203,331 | B2 | 4/2007 | Boesen | |
| 7,209,569 | B2 | 4/2007 | Boesen | |
| 7,215,790 | B2 | 5/2007 | Boesen et al. | |
| 7,463,902 | B2 | 12/2008 | Boesen | |
| 7,508,411 | B2 | 3/2009 | Boesen | |
| 7,983,628 | B2 | 7/2011 | Boesen | |
| 8,140,357 | B1 | 3/2012 | Boesen | |
| 8,526,649 | B2 * | 9/2013 | Foo | H04R 25/554 381/312 |
| 9,270,244 | B2 * | 2/2016 | Usher | H04R 1/1041 |
| 2001/0005197 | A1 | 6/2001 | Mishra et al. | |
| 2001/0027121 | A1 | 10/2001 | Boesen | |
| 2001/0056350 | A1 | 12/2001 | Calderone et al. | |
| 2002/0002413 | A1 | 1/2002 | Tokue | |
| 2002/0007510 | A1 | 1/2002 | Mann | |
| 2002/0010590 | A1 | 1/2002 | Lee | |
| 2002/0030637 | A1 | 3/2002 | Mann | |
| 2002/0046035 | A1 | 4/2002 | Kitahara et al. | |
| 2002/0057810 | A1 | 5/2002 | Boesen | |
| 2002/0076073 | A1 | 6/2002 | Taenzer et al. | |
| 2002/0118852 | A1 | 8/2002 | Boesen | |
| 2003/0002705 | A1 * | 1/2003 | Boesen | H04M 1/6066 381/380 |
| 2003/0065504 | A1 | 4/2003 | Kraemer et al. | |
| 2003/0100331 | A1 | 5/2003 | Dress et al. | |
| 2003/0104806 | A1 | 6/2003 | Ruef et al. | |
| 2003/0115068 | A1 | 6/2003 | Boesen | |
| 2003/0125096 | A1 | 7/2003 | Boesen | |
| 2003/0218064 | A1 | 11/2003 | Conner et al. | |
| 2004/0070564 | A1 | 4/2004 | Dawson et al. | |
| 2004/0160511 | A1 | 8/2004 | Boesen | |
| 2005/0043056 | A1 | 2/2005 | Boesen | |
| 2005/0125320 | A1 | 6/2005 | Boesen | |
| 2005/0148883 | A1 | 7/2005 | Boesen | |
| 2005/0165663 | A1 | 7/2005 | Razumov | |
| 2005/0196009 | A1 | 9/2005 | Boesen | |
| 2005/0251455 | A1 | 11/2005 | Boesen | |
| 2005/0266876 | A1 | 12/2005 | Boesen | |
| 2006/0029246 | A1 | 2/2006 | Boesen | |
| 2006/0074671 | A1 | 4/2006 | Farmaner et al. | |
| 2006/0074808 | A1 | 4/2006 | Boesen | |
| 2008/0254780 | A1 | 10/2008 | Kuhl et al. | |
| 2008/0298606 | A1 * | 12/2008 | Johnson | H04R 1/1091 381/74 |
| 2009/0010461 | A1 * | 1/2009 | Klinghult | A61B 5/0002 381/309 |
| 2012/0010461 | A1 * | 1/2012 | Goldfarb | A61B 17/0401 600/37 |

OTHER PUBLICATIONS

Bragi Update—Arrival of Prototype Chassis Parts—More People—Awesomeness (May 13, 2014).

Bragi Update—Chinese New Year, Design Verification, Charging Case, More People, Timeline(Mar. 6, 2015).

Bragi Update—First Sleeves From Prototype Tool—Software Development Kit (Jun. 5, 2014).

Bragi Update—Let's Get Ready to Rumble, A Lot to Be Done Over Christmas (Dec. 22, 2014).

Bragi Update—Memories From April—Update on Progress (Sep. 16, 2014).

Bragi Update—Memories from May—Update on Progress—Sweet (Oct. 13, 2014).

Bragi Update—Memories From One Month Before Kickstarter—Update on Progress (Jul. 10, 2014).

Bragi Update—Memories From the First Month of Kickstarter—Update on Progress (Aug. 1, 2014).

Bragi Update—Memories From the Second Month of Kickstarter—Update on Progress (Aug. 22, 2014).

Bragi Update—New People @BRAGI—Prototypes (Jun. 26, 2014).

Bragi Update—Office Tour, Tour to China, Tour to CES (Dec. 11, 2014).

Bragi Update—Status on Wireless, Bits and Pieces, Testing—Oh Yeah, Timeline(Apr. 24, 2015).

Bragi Update—The App Preview, The Charger, The SDK, BRAGI Funding and Chinese New Year (Feb. 11, 2015).

Bragi Update—What We Did Over Christmas, Las Vegas & CES (Jan. 19, 2014).

Bragi Update—Years of Development, Moments of Utter Joy and Finishing What We Started(Jun. 5, 2015).

(56) References Cited

OTHER PUBLICATIONS

Bragi Update—Alpha 5 and Back to China, Backer Day, On Track(May 16, 2015).
Bragi Update—Beta2 Production and Factory Line(Aug. 20, 2015).
Bragi Update—Developer Units Shipping and Status(Oct. 5, 2015).
Bragi Update—Developer Units Started Shipping and Status (Oct. 19, 2015).
Bragi Update—Developer Units, Investment, Story and Status(Nov. 2, 2015).
Bragi Update—Getting Close(Aug. 6, 2014).
Bragi Update—On Track, Design Verification, How It Works and What's Next(Jul. 15, 2015).
Bragi Update—Status on Wireless, Supply, Timeline and Open House@Bragi(Apr. 1, 2015).
Bragi Update—Unpacking Video, Reviews on Audio Perform and Boy are We Getting Close(Sep. 10, 2015).
Last Push Before the Kickstarter Campaign Ends on Monday 4pm CET (Mar. 28, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From Bragi—$3,000,000—Yipee (Mar. 22, 2014).

* cited by examiner

EARPIECE WITH ELECTRONIC ENVIRONMENTAL SOUND PASS-THROUGH SYSTEM

FIELD OF THE INVENTION

The present invention relates to wearable devices. More particularly, but not exclusively, the present invention relates to ear pieces.

BACKGROUND OF THE ART

The positioning of an earpiece at the external auditory canal of a user brings with it many benefits. The user is able to perceive sound directed from the speaker toward the tympanic membrane, allowing for a richer auditory experience. This may be the spoken voice, music or other types of sounds. However, many earpieces rely on utilization of all of the available space of the external auditory canal luminal area in order to allow for stable placement and position maintenance. If this completely occludes the entire lumen of the external canal, then a conductive hearing loss due to said canal occlusion may result. This has the disadvantage of blocking the ambient environmental sounds from entry into the canal and subsequent processing of environmental sound through the middle and inner ears. Such a conductive hearing loss can be as high as 30 to 35 dB. What is needed is a way to allow environmental sounds to be electronically transmitted through the external auditory canal to the tympanic membrane. Thus, the environmental sounds transmitted to the tympanic membrane would allow for identical processing via the middle ear ossicular chain and inner ear transmission of the transduced sounds to higher neural pathways. This would electronically reproduce an open and non-occluded external auditory canal.

SUMMARY

Therefore, it is a primary object, feature, or advantage to improve over the state of the art.

It is a further object, feature, or advantage to provide the ability to use an external microphone and medially placed speaker in order to replicate the sound that would otherwise pass unimpeded into the external auditory canal and presented to the tympanic membrane of an individual.

It is a still further object, feature, or advantage to completely remove any occlusion effect from an external auditory canal earpiece.

Another object, feature, or advantage of the present invention is to allow for transmission of environmental sounds under a range of conditions. Even if the canal is not occluded to 95% of luminal area, the biologically formed debris such as cerumen may occlude and transmission of environmental sounds should occur even in these conditions.

Yet another object, feature, or advantage is to provide greater user safety by maintaining the user's ability to perceive environmental sounds as they occur.

A further object, feature, or advantage is to prevent any occlusion effect.

A still further object, feature, or advantage is to allow for transmission in biologically partially occluded external auditory canals.

Another object, feature, or advantage is to minimize discomfort from the user perspective by prevention of the sensation of plugged ears.

One or more of these and/or other objects, features, or advantages of the present invention will become apparent from the specification and claims that follow. No single embodiment need exhibit each and every object, feature, or advantage. It is contemplated that different embodiments may have different objects, features, or advantages.

According to one aspect, an ear piece for use by an individual having an external auditory canal includes an earpiece housing configured for placement on, at or within the external auditory canal of the individual, a processor disposed within the ear piece housing, at least one microphone disposed at the earpiece housing wherein the at least one earpiece is positioned to detect ambient environmental sound, and at least one speaker disposed within the earpiece housing at a position to direct sound towards a tympanic membrane of the individual. The ear piece is configured to detect ambient environmental sound proximate the external auditory canal of the individual using the at least one microphone and reproduce the ambient environmental sound at the at least one speaker within the earpiece housing. The ear piece housing may be water resistant. The ear piece may further include at least one biological sensor operatively connected to the processor. The at least one biological sensor may include a pulse oximeter and/or temperature sensor, a blood alcohol level sensor, a blood glucose sensor, a bilirubin sensor, a blood pressure sensor, an electroencephalogram sensor, an Adenosine Triphosphate (ATP) sensor, a lactic acid sensor, a hemoglobin sensor, a hematocrit sensor, or other biological sensor. The earpiece may further include a chemical sensor. The earpiece may further include at least one inertial sensor. The inertial sensor may be an accelerometer, a gyrometer, a gyro sensor, a magnetometer or other sensor. The earpiece may also include a spectrometer operatively connected to the processor which may be positioned for measuring ambient environmental conditions. The ear piece may also include an electromagnetic field transceiver operatively connected to the processor for linking the processor to a network such as personal area network or other device.

According to another aspect a method for an ear canal device is provided. The method may include providing an ear piece for use by an individual having an external auditory canal, the ear piece comprising an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing at a position to direct sound towards a tympanic membrane of the individual. The method may further include detecting ambient environmental sound proximate the external auditory canal of the individual using the at least one microphone and reproducing at the ambient environmental sound at the at least one speaker within the earpiece housing to thereby provide for audio transparency.

DETAILED DESCRIPTION

The present invention relates to a device that may be positioned on, at or within the external auditory canal of a user yet be acoustically non-occlusive. This may be accomplished by using an external microphone to take sound from the environment and transmit at its speaker nearest the tympanic membrane of an individual wearing or using the device. It is noted that a device typically may be considered to be non-occlusive if it does not occupy the near entirety of the luminal area of the external auditory canal. In addition, a device may be non-occlusive, but may abut cerumen in the external auditory canal making it essentially occlusive. Regardless of whether the device fully blocks the external auditory canal or not anatomically, sound may be received at a microphone on the outer portion of the device and communicated for reproduction at a speaker on the inner portion of the device. The resulting device effectively renders the ear canal device acoustically transparent. Sound would be able to be captured at the external microphone and then sent via the earpiece speaker to the tympanic membrane of the user at the same sound pressure levels as would be present without the earpiece whatsoever. This would create an acoustic environment where the device residing at, on or in the external auditory canal is acoustically transparent. This would have the advantage of allowing the user to capture environmental sounds that would otherwise be blocked from transmission and central processing, creating a non-occlusive earpiece regardless of physical shape characteristics.

Figure 1:
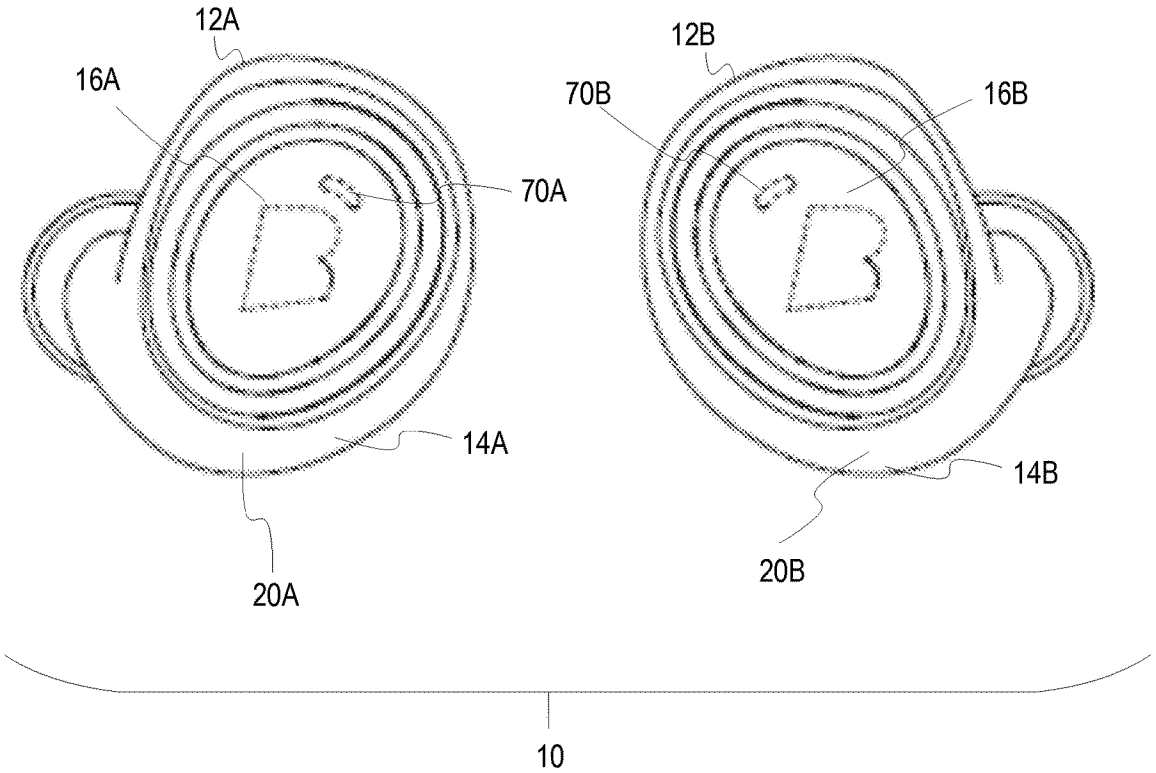
FIG. 1 illustrates one example of a wearable device in the form of a set of earpieces.

FIG. 1 illustrates one example of a wearable device in the form of a set of earpieces 10 including a left ear piece 12A and a right earpiece 12B. Each of the ear pieces 12A, 12B has a housing 14A, 14B which may be in the form of a protective shell or casing and may be an in-the-ear earpiece housing. A left infrared through ultraviolet spectrometer 16A and right infrared through ultraviolet spectrometer 16B is also shown. Air microphones 70A, 70B are also shown. Note that the air microphones 70A, 70B are outward facing such that the air microphones 70A, 70B may capture ambient environmental sound. It is to be understood that any number of microphones may be present. Note that when each of the earpieces 12A, 12B is placed at and within a corresponding external auditory canal, the external auditory canal of the user would be physically blocked and not open. Thus, the user would not conventionally be able to hear ambient noise. Although perhaps appropriate for use in a hearing aid, this blocking of ambient environmental sound is problematic and it is desirous to remove any occlusion effect from the external auditory canal.

It is further noted that there are various advantages associated with removing this occlusive effect. This includes greater user safety. By allowing ambient sounds to be passed through the device to the user, the user does not lose the sense of hearing as the user would with head phones or other devices that limit the user's ability to hear ambient sound. Thus, a user can hear sounds associated with danger such as warnings from others, vehicles, animals, or other sounds which may be associated with the potential for physical harm.

In addition, the ability to allow ambient sounds to pass assists in reducing discomfort from the user perspective in that it assists in preventing the sensation of plugged ears because the environmental audio is reproduced.

Figure 2:
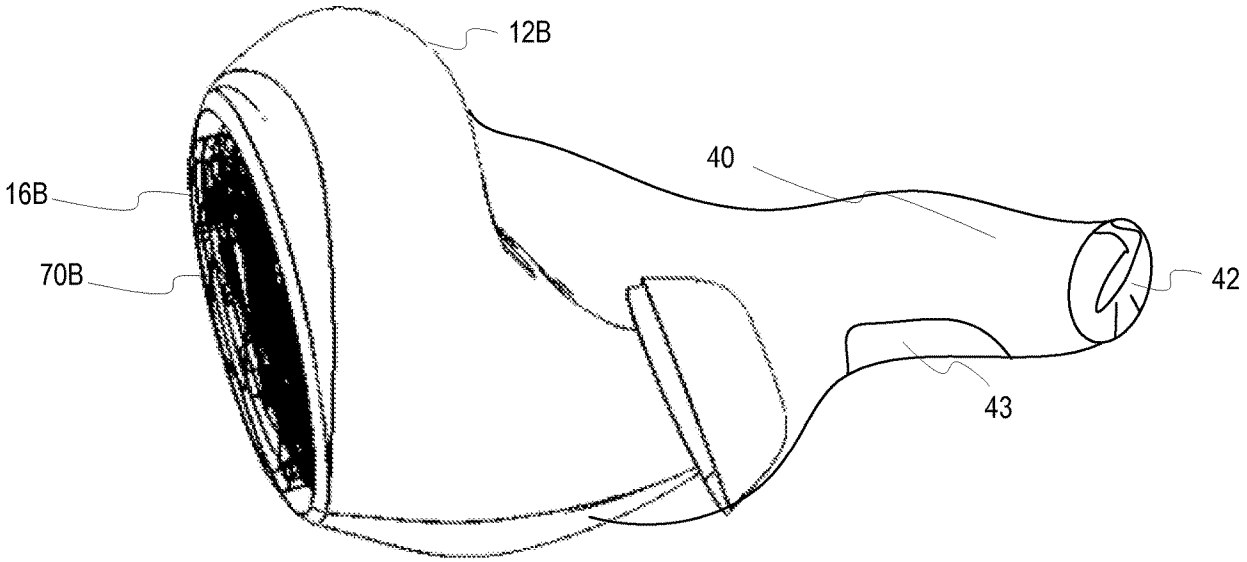
FIG. 2 illustrates one example of an ear piece positioned within an external auditory canal of an individual.

FIG. 2 illustrates an ear piece 12B placed on and inserted into an ear of an individual or user. The ear piece 12B fits at least partially into the external auditory canal 40 of the individual. A tympanic membrane 42 is shown at the end of the external auditory canal 40. It is to be understood that the ear piece 12B may completely block the external auditory canal physically or partially block the external auditory canal 40, yet environmental sound may still be produced. It is also contemplated that even if the ear piece 12B does not completely block the external auditory canal, cerumen 43 may collect to effectively block the external auditory canal. Thus, the ability to reproduce ambient or environmental sound captured from outside of the ear piece and to reproduce it within the ear piece may be advantageous regardless of whether the device itself blocks or does not block the external auditory canal and regardless of whether the combination of the device and cerumen impaction blocks the external auditory canal. It is to be further understood that different individuals have external auditory canals of varying sizes and shapes and so the same device which completely blocks the external auditory canal of one user would not necessarily block the external auditory canal of another user.

Figure 3:
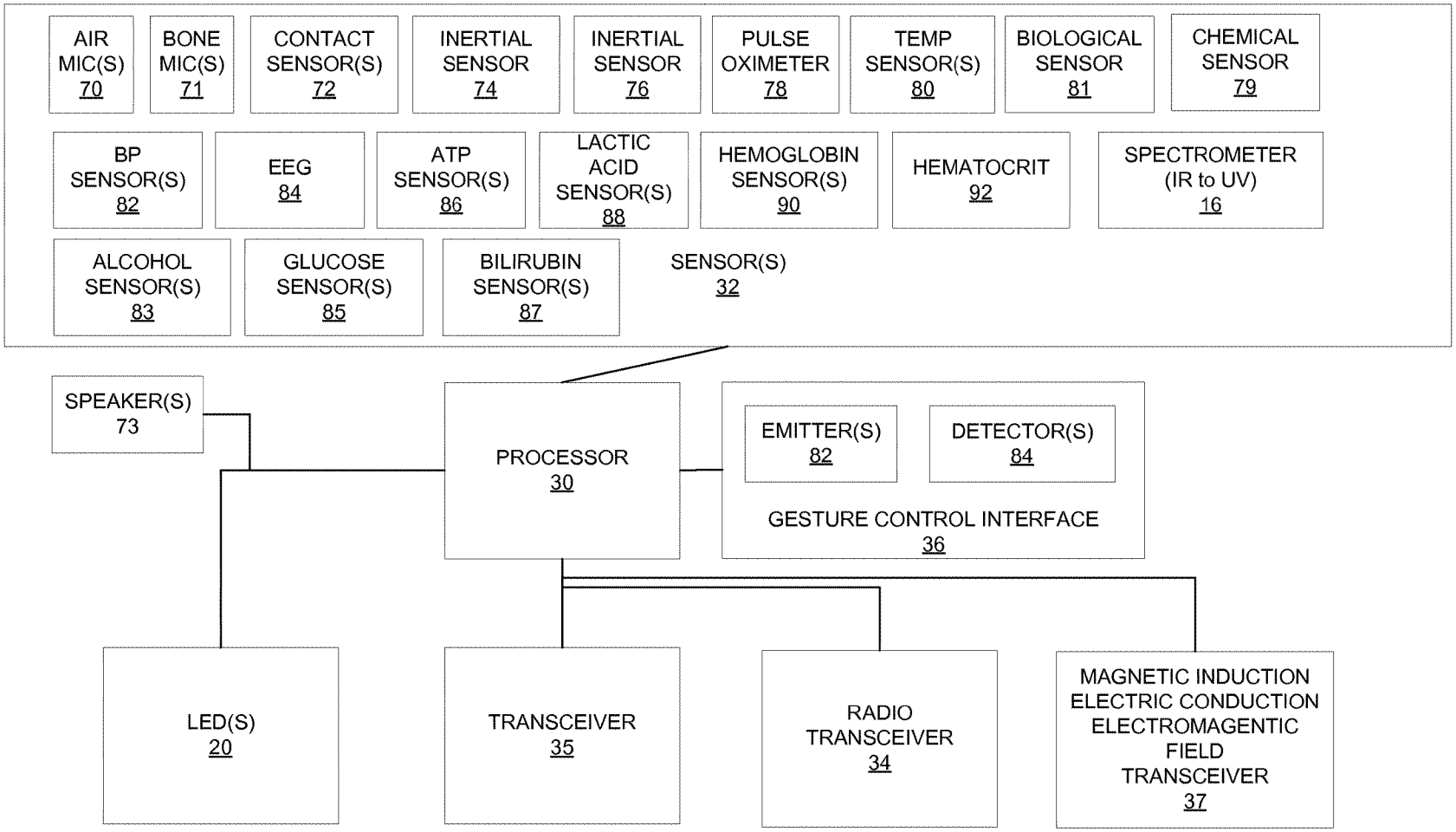
FIG. 3 is a block diagram illustrating one example of a device.

FIG. 3 is a block diagram illustrating a device. The device may include one or more LEDs 20 electrically connected to a processor 30. The processor 30 may also be electrically connected to one or more sensors 32. Where the device is an earpiece, the sensor(s) may include an inertial sensor 74, another inertial sensor 76. Each inertial sensor 74, 76 may include an accelerometer, a gyro sensor or gyrometer, a magnetometer or other type of inertial sensor. The sensor(s) 32 may also include one or more contact sensors 72, one or more bone conduction microphones 71, one or more air conduction microphones 70, one or more chemical sensors 79, a pulse oximeter 76, a temperature sensor 80, or other physiological or biological sensor(s). Further examples of physiological or biological sensors include an alcohol sensor 83, glucose sensor 85, or bilirubin sensor 87. Other examples of physiological or biological sensors may also be included in the device. These may include a blood pressure sensor 82, an electroencephalogram (EEG) 84, an Adenosine Triphosphate (ATP) sensor, a lactic acid sensor 88, a hemoglobin sensor 90, a hematocrit sensor 92 or other biological or chemical sensor.

A spectrometer 16 is also shown. The spectrometer 16 may be an infrared (IR) through ultraviolet (UV) spectrometer although it is contemplated that any number of wavelengths in the infrared, visible, or ultraviolet spectrums may be detected. The spectrometer 16 is preferably adapted to measure environmental wavelengths for analysis and recommendations and thus preferably is located on or at the external facing side of the device.

A gesture control interface 36 is also operatively connected to the processor 30. The gesture control interface 36 may include one or more emitters 82 and one or more detectors 84 for sensing user gestures. The emitters may be of any number of types including infrared LEDs. The device may include a transceiver 35 which may allow for induction transmissions such as through near field magnetic induction. A short range transceiver 34 using Bluetooth, UWB, or other means of radio communication may also be present. In operation, the processor 30 may be configured to convey different information using one or more of the LED(s) 20 based on context or mode of operation of the device. The various sensors 32, the processor 30, and other electronic components may be located on the printed circuit board of the device. One or more speakers 73 may also be operatively connected to the processor 30.

A magnetic induction electric conduction electromagnetic (E/M) field transceiver 37 or other type of electromagnetic field receiver is also operatively connected to the processor 30 to link the processor 30 to the electromagnetic field of the user. The use of the E/M transceiver 37 allows the device to link electromagnetically into a personal area network or body area network or other device.

Figure 4:
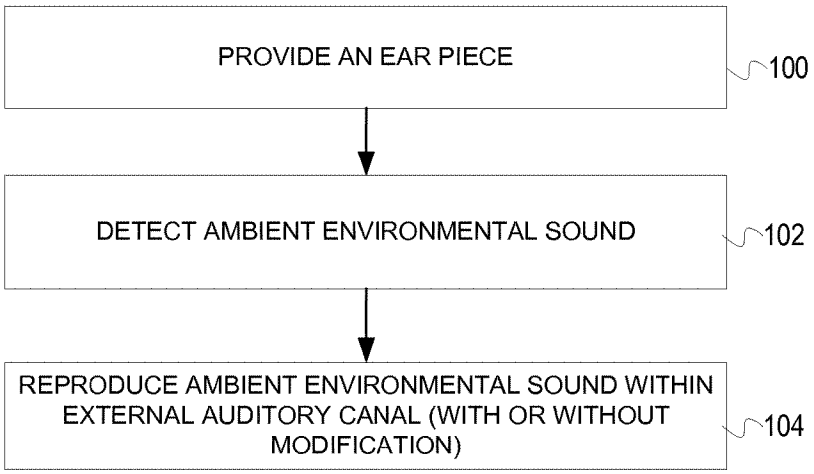
FIG. 4 illustrates one example of a method.

FIG. 4 illustrates one example of a method. As shown in FIG. 4, in step 100 an ear piece is produced. In step 102, the ambient environmental sound is detected. In step 104, the ambient environmental sound is reproduced within the external auditory canal without or with modification. Where the ambient environmental sound is reproduced with modification the modification may take into account the size and shape of the external auditory canal of the individual in order to modify any received signal in a manner to best approximate or reproduce the sound as if heard directly by the user as opposed to having the sound sensed on one side of the ear piece (the external side) and reproduced at the other side of the ear piece (the inner side nearest the tympanic membrane).

Therefore, various examples of systems, devices, apparatus, and methods for restoring auditory transparency when using ear canal devices through the use of at least one external facing microphone to detect incoming auditory stimuli have been shown and described. Although various embodiments and examples have been set forth, the present invention contemplates numerous variations, options, and alternatives.

What is claimed is:

1. An ear piece for use by an individual having an external auditory canal, comprising:

an earpiece housing configured for placement on, at, or within the external auditory canal of the individual;

a processor disposed within the ear piece housing;

a first microphone disposed at the earpiece housing, wherein the first microphone is outwardly facing at an outer portion of the earpiece housing to detect ambient environmental sound;

a second microphone disposed at the earpiece housing;

at least one speaker disposed within the earpiece housing at a position to direct sound towards the tympanic membrane of the individual;

wherein the ear piece is configured to detect ambient environmental sound proximate the external auditory canal of the individual using the first microphone, and producing a modified sound including the ambient environmental sound at the at least one speaker within the earpiece housing;

wherein the modified sound including the ambient environmental sound is based in part on a size and shape of the external auditory canal of the individual such that the modified sound reproduces the ambient environmental sound as if directly heard by the individual.

2. The ear piece of claim 1 wherein the earpiece housing is water resistant.

3. The ear piece of claim 1 further comprising at least one biological sensor operatively connected to the processor.

4. The ear piece of claim 3 wherein the at least one biological sensor comprises a pulse oximeter.

5. The ear piece of claim 3 wherein the at least one biological sensor comprises a temperature sensor.

6. The earpiece of claim 3 wherein the at least one biological sensor includes a blood alcohol level sensor.

7. The earpiece of claim 3 wherein the at least one biological sensor includes a blood glucose sensor.

8. The earpiece of claim 3 wherein the at least one biological sensor includes a bilirubin sensor.

9. The earpiece of claim 3 wherein the at least one biological sensor includes a blood pressure sensor.

10. The earpiece of claim 3 wherein the at least one biological sensor includes an electroencephalogram sensor.

11. The earpiece of claim 3 wherein the at least one biological sensor includes an Adenosine Triphosphate (ATP) sensor.

12. The earpiece of claim 3 wherein the at least one biological sensor includes a lactic acid sensor.

13. The earpiece of claim 3 wherein the at least one biological sensor includes a hemoglobin sensor.

14. The earpiece of claim 3 wherein the at least one biological sensor includes a hematocrit sensor.

15. The ear piece of claim 1 further comprising at least one chemical sensor operatively connected to the processor.

16. The ear piece of claim 1 further comprising at least one inertial sensor operatively connected to the processor.

17. The ear piece of claim 16 wherein the at least one inertial sensor includes an accelerometer.

18. The ear piece of claim 16 wherein the at least one inertial sensor includes a gyro sensor.

19. The ear piece of claim 16 wherein the at least one inertial sensor includes a magnetometer.

20. The ear piece of claim 1 further comprising a spectrometer operatively connected to the processor.

21. The ear piece of claim 20 wherein the spectrometer is positioned for measuring ambient environmental conditions.

22. The ear piece of claim 1 further comprising an electromagnetic field transceiver operatively connected to the processor for linking the processor to a network.

23. The ear piece of claim 22 wherein the network is a personal area network.

24. The ear piece of claim 22 wherein the electromagnetic field transceiver is a magnetic induction electric conduction transceiver.

25. The ear piece of claim 22 wherein the electromagnetic field transceiver provides for galvanic communication.

26. The ear piece of claim 22 wherein the electromagnetic field transceiver provides for power transmission and/or reception.

27. A method comprising:

providing an ear piece for use by an individual having an external auditory canal, the ear piece comprising an earpiece housing configured for placement on, at, or within the external auditory canal of the individual, a processor disposed within the ear piece housing, a first microphone disposed within the earpiece housing wherein the first microphone is positioned to detect ambient environmental sound, and at least one speaker disposed within the earpiece housing at a position to direct sound towards a tympanic membrane of the individual;

detecting ambient environmental sound proximate the external auditory canal of the individual using the first microphone;

modifying the ambient environment sound using the processor to create a modified ambient environment sound wherein the modified environmental sound is based in part on a size and shape of the external auditory canal of the individual such that the modified environment sound reproduces the ambient environmental sound as if directly heard by the individual; and producing the modified ambient environment sound at the at least one speaker within the earpiece housing to thereby provide for audio transparency.

28. The method of claim 27 further comprising controlling functionality of the ear piece using a gestural control interface of the earpiece.

29. The method of claim 27 wherein the reproducing occurs at one of the at least one speaker nearest a tympanic membrane of the individual.

30. The method of claim 27 wherein the ear piece further comprises a biological sensor and further comprising sensing a biological parameter using the biological sensor.

31. The method of claim 30 wherein the biological sensor comprises a pulse oximeter.

32. The method of claim 30 wherein the biological sensor comprises a temperature sensor.

33. The method of claim 30 wherein the biological sensor comprises a blood alcohol level sensor.

34. The method of claim 30 wherein the biological sensor comprises a blood glucose sensor.

35. The method of claim 30 wherein the biological sensor comprises a bilirubin sensor.

36. The method of claim 30 wherein the biological sensor includes a blood pressure sensor.

37. The method of claim 30 wherein the biological sensor includes an electroencephalogram sensor.

38. The method of claim 30 wherein the biological sensor includes an Adenosine Triphosphate (ATP) sensor.

39. The method of claim 30 wherein the biological sensor includes a lactic acid sensor.

40. The method of claim 30 wherein the biological sensor includes a hemoglobin sensor.

41. The method of claim 30 wherein the biological sensor includes a hematocrit sensor.

42. The method of claim 27 wherein the earpiece further comprises a chemical sensor and the method further comprises sensing a chemical parameter using the chemical sensor.

43. The method of claim 27 further comprising detecting ambient light using a photometer of the ear piece.

44. The method of claim 43 wherein the light comprises infrared light.

45. The method of claim 43 wherein the light comprises ultraviolet light.

46. The method of claim 43 wherein the light comprises visible light.

47. The method of claim 27 wherein the ear piece further comprises an electromagnetic field transceiver operatively connected to the processor for linking the processor to a network.

48. The method of claim 47 further comprising communicating data to or from the network using the electromagnetic field transceiver.

49. The method of claim 48 wherein the network is personal area network.

50. The method of claim 48 wherein the electromagnetic field transceiver is a magnetic induction electric conduction transceiver.

51. The method of claim 48 wherein the electromagnetic field transceiver provides for galvanic communication.

52. The method of claim 48 wherein the electromagnetic field transceiver provides for power transmission and/or reception.

53. An ear piece for use by an individual having an external auditory canal, comprising:

an earpiece housing configured for placement on, at, or within the external auditory canal of the individual;

a processor disposed within the ear piece housing;

a first microphone disposed at the earpiece housing wherein the at least one earpiece is positioned to detect ambient environmental sound with the first microphone; and at least one speaker disposed within the earpiece housing at a position to direct sound towards a tympanic membrane of the individual;

wherein the ear piece is configured to detect ambient environmental sound proximate the external auditory canal of the individual using the first microphone, modify the ambient environmental sound via the processor to create a modified ambient environmental sound, wherein the modified ambient environmental sound is based in part on a size and shape of the external auditory canal of the individual such that the modified ambient environmental sound reproduces the ambient environmental sound as if directly heard by the individual, and produce the modified ambient environmental sound at the at least one speaker.

54. The earpiece of claim 53 wherein the earpiece housing at least partially blocks the external auditory canal of the individual.

55. The earpiece of claim 53 wherein the ear piece accommodates for at least partial cerumen impaction by reproducing the ambient environmental sound when partial cerumen impaction is present in the external auditory canal.

56. The earpiece of claim 53 wherein the ear piece accommodates for cerumen impaction by reproducing the ambient environmental sound when cerumen impaction in combination with the earpiece housing blocks the external auditory canal.

57. The ear piece of claim 53 wherein the earpiece housing is water resistant.

58. The ear piece of claim 53 further comprising at least one biological sensor operatively connected to the processor.

59. The ear piece of claim 58 wherein the at least one biological sensor comprises a pulse oximeter.

60. The earpiece of claim 58 wherein the at least one biological sensor comprises a temperature sensor.

61. The earpiece of claim 58 wherein the at least one biological sensor includes a blood alcohol level sensor.

62. The earpiece of claim 58 wherein the at least one biological sensor includes a blood glucose sensor.

63. The earpiece of claim 58 wherein the at least one biological sensor includes a bilirubin sensor.

64. The earpiece of claim 58 wherein the at least one biological sensor includes a blood pressure sensor.

65. The earpiece of claim 58 wherein the at least one biological sensor includes an electroencephalogram sensor.

66. The earpiece of claim 58 wherein the at least one biological sensor includes an Adenosine Triphosphate (ATP) sensor.

67. The earpiece of claim 58 wherein the at least one biological sensor includes a lactic acid sensor.

68. The earpiece of claim 58 wherein the at least one biological sensor includes a hemoglobin sensor.

69. The earpiece of claim 58 wherein the at least one biological sensor includes a hematocrit sensor.

70. The ear piece of claim 53 further comprising at least one chemical sensor operatively connected to the processor.

71. The ear piece of claim 53 further comprising at least one inertial sensor operatively connected to the processor.

72. The ear piece of claim 71 wherein the at least one inertial sensor includes an accelerometer.

73. The ear piece of claim 71 wherein the at least one inertial sensor includes a gyro sensor.

74. The ear piece of claim 71 wherein at least one inertial sensor includes a magnetometer.

75. The ear piece of claim 71 further comprising a spectrometer operatively connected to the processor.

76. The ear piece of claim 75 wherein the spectrometer is positioned for measuring ambient environmental conditions.

77. The ear piece of claim 53 further comprising an electromagnetic field transceiver operatively connected to the processor for linking the processor to a network.

78. The ear piece of claim 77 wherein the network is a personal area network.

79. The ear piece of claim 77 wherein the electromagnetic field transceiver is a magnetic induction electric conduction transceiver.

80. The ear piece of claim 77 wherein the electromagnetic field transceiver provides for galvanic communication.

81. The ear piece of claim 77 wherein the electromagnetic field transceiver provides for power transmission and/or reception.

82. A head set comprising the ear piece of claim 53.

83. An ear piece for use by an individual having an external auditory canal, comprising:

an earpiece housing configured for placement on, at, or within the external auditory canal of the individual;

a processor disposed within the ear piece housing;

a first microphone disposed at the earpiece housing, wherein the first microphone is outwardly facing at an outer portion of the earpiece housing to detect ambient environmental sound;

a second microphone disposed at the earpiece housing;

at least one speaker disposed within the earpiece housing at a position to direct sound towards the tympanic membrane of the individual;

an inertial sensor disposed within the earpiece housing and operatively connected to the processor;

a gestural control interface operatively connected to the processor for controlling the ear piece;

wherein the ear piece is configured to detect ambient environmental sound proximate the external auditory canal of the individual using the first microphone, and producing a modified sound including the ambient environmental sound at the at least one speaker within the earpiece housing;

wherein the modified sound including the ambient environmental sound is based in part on a size and shape of the external auditory canal of the individual such that the modified sound reproduces the ambient sound as if directly heard by the individual.

* * * * *